United States Patent [19]

Sano

[11] 4,244,311

[45] Jan. 13, 1981

[54] ZIGZAG SEWING MACHINE WITH A PATTERN SELECTING DEVICE

[75] Inventor: Yasuro Sano, Hachioji, Japan

[73] Assignee: Janome Sewing Machine Co., Ltd., Tokyo, Japan

[21] Appl. No.: 40,274

[22] Filed: May 18, 1979

[30] Foreign Application Priority Data

Feb. 16, 1979 [JP] Japan ..... 54-17067

[51] Int. Cl.[3] ..... D05B 3/02

[52] U.S. Cl. ..... 112/158 A; 112/158 D

[58] Field of Search ..... 112/158 A, 158 D, 158 R

[56] References Cited

U.S. PATENT DOCUMENTS

| | | | |
|---|---|---|---|
| 3,257,980 | 6/1966 | Koike | 112/158 D |
| 3,795,210 | 3/1974 | Adams | 112/158 D |
| 4,084,523 | 4/1978 | Kasuga | 112/158 A |

*Primary Examiner*—Peter P. Nerbun

*Attorney, Agent, or Firm*—Michael J. Striker

[57] ABSTRACT

A sewing machine comprises a machine housing, a drive shaft rotatably mounted on the housing for a vertical reciprocating movement of a needle bar carrying the needle, a swingable support for supporting the needle bar and a group of cams rotated by the drive shaft and including a plurality of pattern cams for controlling the lateral swinging movement of the needle bar. A cam follower is operatively connected to the needle bar to selectively engage the pattern cams for transmitting the movements in accordance with the pattern cams. A manually rotating dial is operatively connected to the cam follower to selectively engage the cam follower to the pattern cams for selecting the feeding amounts in accordance with the selected pattern cams.

6 Claims, 5 Drawing Figures

ZIGZAG SEWING MACHINE WITH A PATTERN SELECTING DEVICE

BRIEF DESCRIPTION OF THE INVENTION

The invention relates to a sewing machine, and more particularly relates to a pattern selecting device of a zigzag sewing machine, in which the operating dial of the pattern selecting device can be rotated over a range of rotation angle 360° so as to obtain much more varied stitch patterns from a limited number of pattern cams. Further in this invention, since the minimum rotation angle of the operating dial for selecting a pattern cam is considerably large in relation to a limited number of pattern cams, the associated pattern selecting cams can be simplified and can be provided with so small push angles for operating the cam followers that the machine operator may easily and lightly operate the pattern selecting device without the need of manual operating force.

In the conventional zigzag sewing machine having many pattern cams to be selected by a rotary operating dial, the minimum rotation angle of the operating dial for selecting a pattern cam has to be considerably small. Therefore, the pattern selecting cams operated in association with the operating dial are very complicated and must be provided with so large push angles for operating the cam followers engaging thereto. As the result, the machine operator has to exert a considerable manual force to operate the rotary operating dial in each time to select so many pattern cams.

This invention has been provided to eliminate the defects and shortcomings of the conventional sewing machines. It is a primary object of the invention to provide many stitch patterns substantially twice the number of pattern cams to be used.

It is another object of the invention to provide a pattern selecting device which is simple in structure and easy and light in operation.

It is another object of the invention to selectively control the feed adjusting device in accordance to the selected pattern cams.

It is still another object to repeatedly select the same pattern cams from the initial one by rotating an operating member in one direction.

Many other features and advantages of the invention will be apparent from the following description of the invention in reference to the attached drawings.

DESCRIPTION OF THE INVENTION

Figure 1:
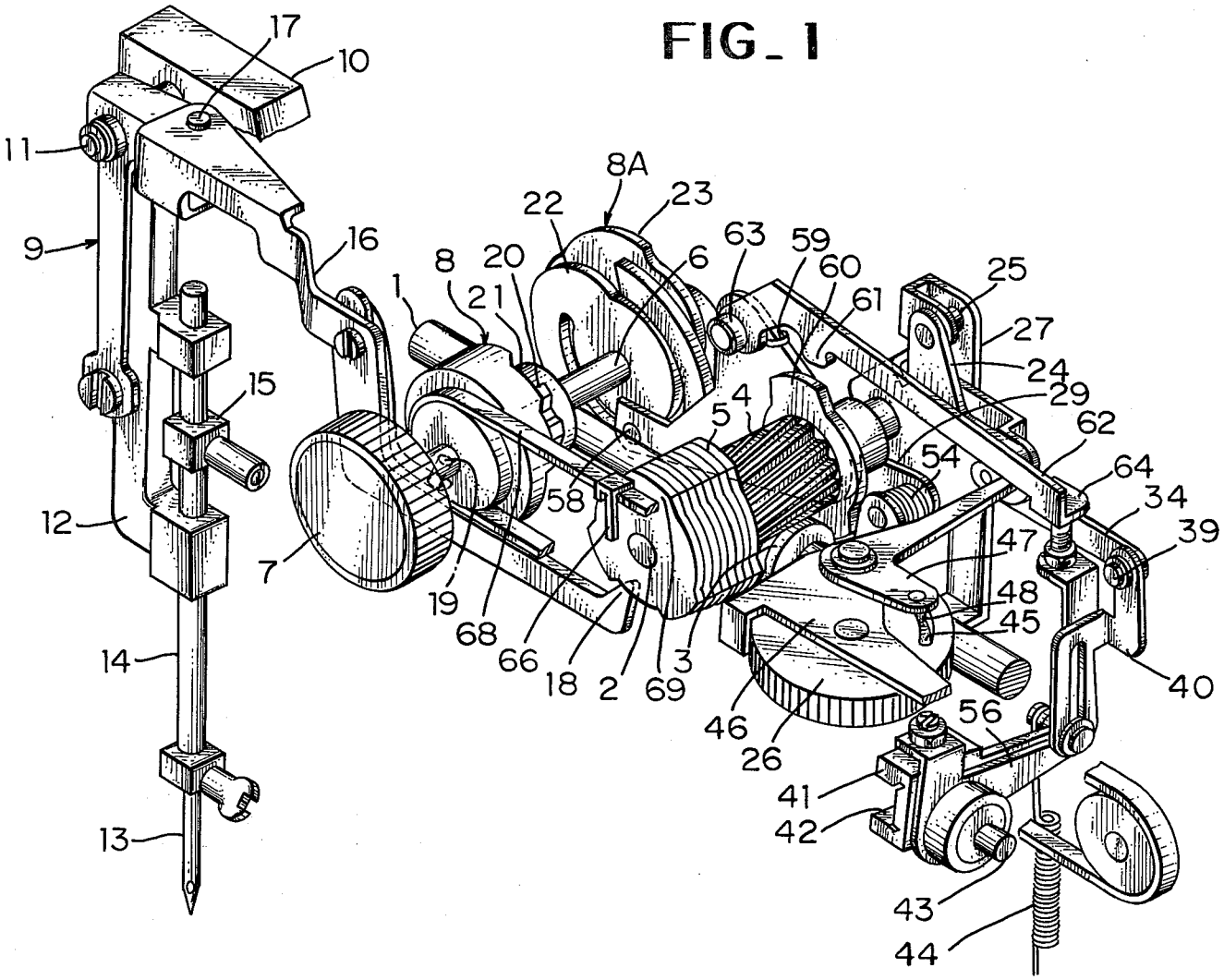
FIG. 1 is a perspective view of the sewing machine of the invention.
Figure 2:
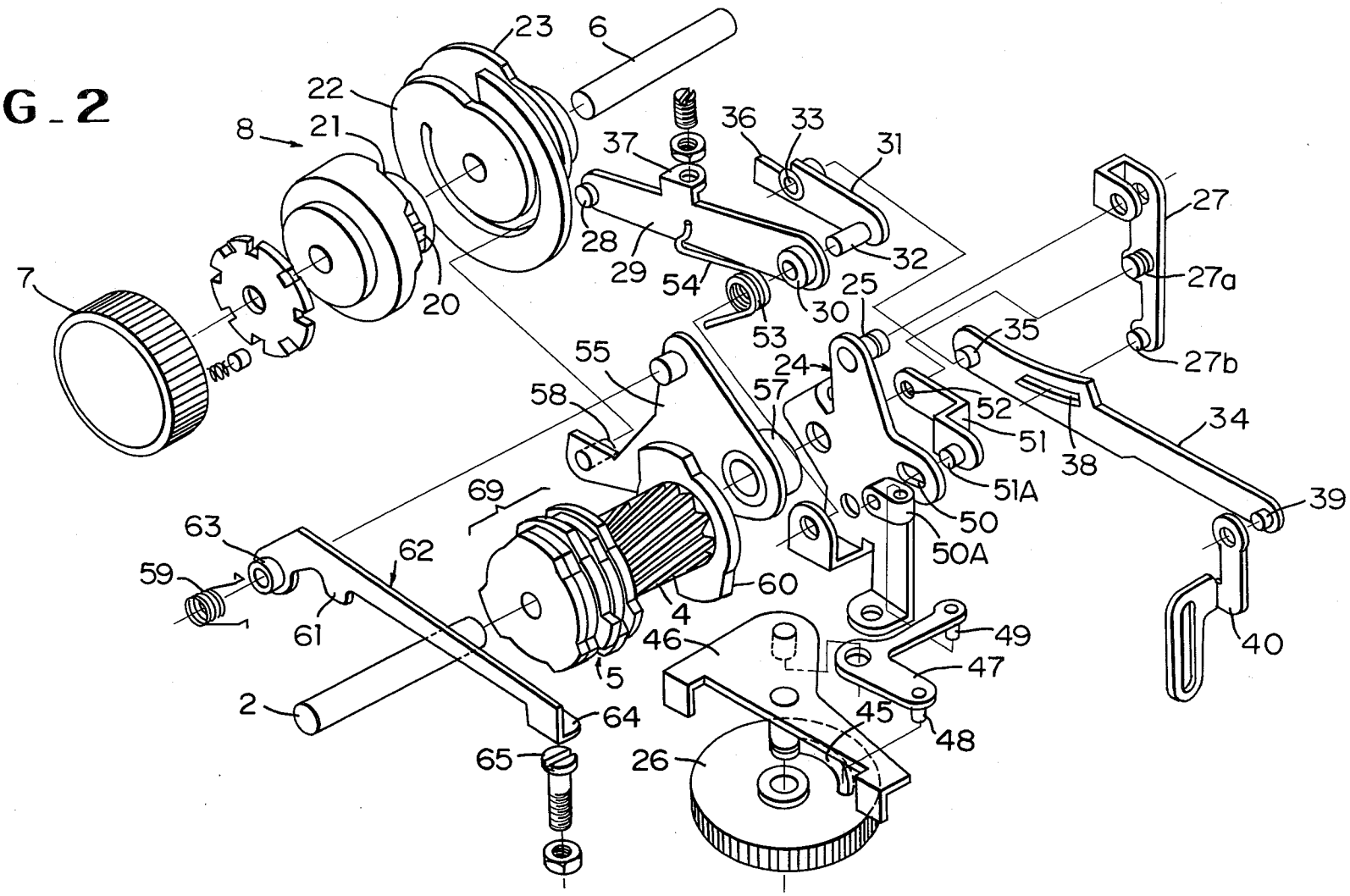
FIG. 2 is an exploded view of the sewing machine of the invention.

In reference to FIGS. 1 and 2, the reference numeral 1 denotes a drive shaft mounted on the machine housing 10, though it is only partly shown and rotated by a drive source such as a machine motor, though it is not shown. A transverse cam shaft 2 is rotatably mounted on the machine housing. The cam shaft 2 carries a group of cams 5 for rotation therewith. The cam shaft is provided with a worm wheel 4 which is in engagement with a worm 3 secured to the drive shaft 1. A transverse control shaft 6 is turnably mounted on the machine housing the control shaft 6 has an operating dial 7 secured to one end thereof which is protruded out of the machine housing. The control shaft carries two sets of control cams 8, 8A.

The reference numeral 9 denotes a needle bar mechanism. A needle bar support 12 is swingably mounted on the machine housing 10 by means of a pin 11. A needle bar 14 with a needle 13 is mounted on the needle support 12 and is vertically reciprocated per rotation of the drive shaft 1 which is operatively connected to a needle bar holder 15 on the needle bar via a crank mechanism (not shown).

A transmission rod 16 is at one end connected to the needle bar support 12 by means of a pivot pin 17 so that the rod 16 may be turnable in a horizontal plane. The transmission rod is formed with a follower 18 at the other end thereof which is pressed against the cam group 5 by means of a spring (not shown). The transmission rod 16 is provided with another follower 19 at the intermediate thereof, which is formed to engage a peripheral cam face 20 and at the same time to engage a side cam face 21 of the control cam group 8. The transmission rod 16 is also biased by a spring (not shown) toward the front face of the sewing machine. The other control cams 22, 23 are engaged by followers 58, 28 respectively as will be explained more in detail.

A swingable arm 27 is mounted by means of a pivot pin 25 on the top of a bracket 24 which is secured to the machine housing. A follower arm 29 having a cam follower 28 at one end thereof has a base 30 turnably mounted on the bracket 24 at the lower part thereof as shown in FIG. 2. The follower 28 of the follower arm 29 is pressed against the spiral cam face of the control cam 23 by means of a torsion spring 53. Further on the base 30 of the follower arm 29 a transmission element 31 is mounted by means of a pivot pin 32 thereof. The transmission element is swingable together with the follower arm 29 on the bracket 24 and displaces a feed adjusting lever 34 in accordance to the cam face of the control cam 23 which is engaged by the follower 28 of the follower arm 29. The transmission element is at the intermediate part 33 connected to one end of the feed adjusting lever 34 by means of a pin 35. The transmission element has an upper part 36 pressed against an abutment 37 of the follower arm 29 by the torsion spring 53 so that the former may be moved together with the follower arm 29. The feed adjusting lever 34 has an arcuate slot 38 formed in the intermediate part thereof which is engaged by a pin **27*b* on the lower part of the swingable arm 27. The feed adjusting lever 34 has the other end 39 connected to a feed adjuster turning element 56 through a connecting link 40. The feed adjuster turning element 56 is operated to turn and determine the angular position of a feed adjuster 41 which is formed with a groove 42 for receiving a block element (not shown). The block element is, as generally known, slidable in the groove 42 and adjusts the movement of the lower drive shaft for controlling the movement of the feed dog by utilization of the rotation of the upper drive shaft 1 of the sewing machine. The feed adjuster 41 is turnably mounted on the machine housing by the shaft 43 thereof, and is biased to one direction by tension spring 44 so that the feed dog may be normally operated to feed the sewn material into the forward direction under the needle. The feed adjuster turning element 56 is also biased by a torsion spring 70 in the same direction with the feed adjuster 41** and is lightly pressed against the latter.

A feed adjuster operating dial 26 is partly protruded out of the machine housing and is manually rotatable. The operating dial 26 is formed with a groove cam 45 which is engaged by a follower pin 48 which is secured to one end of a bell-crank lever 47 which is turnable on a bracket 46 secured to the machine housing. The bell-crank lever 47 has another pin secured to the other end thereof and connected, via a connecting element 50A, to a slide element 51 having a pin 51A which is secured to one end thereof and is in engagement with an elongated slot 50 of the bracket 24 as shown. The element 51 has a hole 52 formed on the other end thereof which is engaged by a pin 27*a* of the swingable arm 27.

Figure 3:
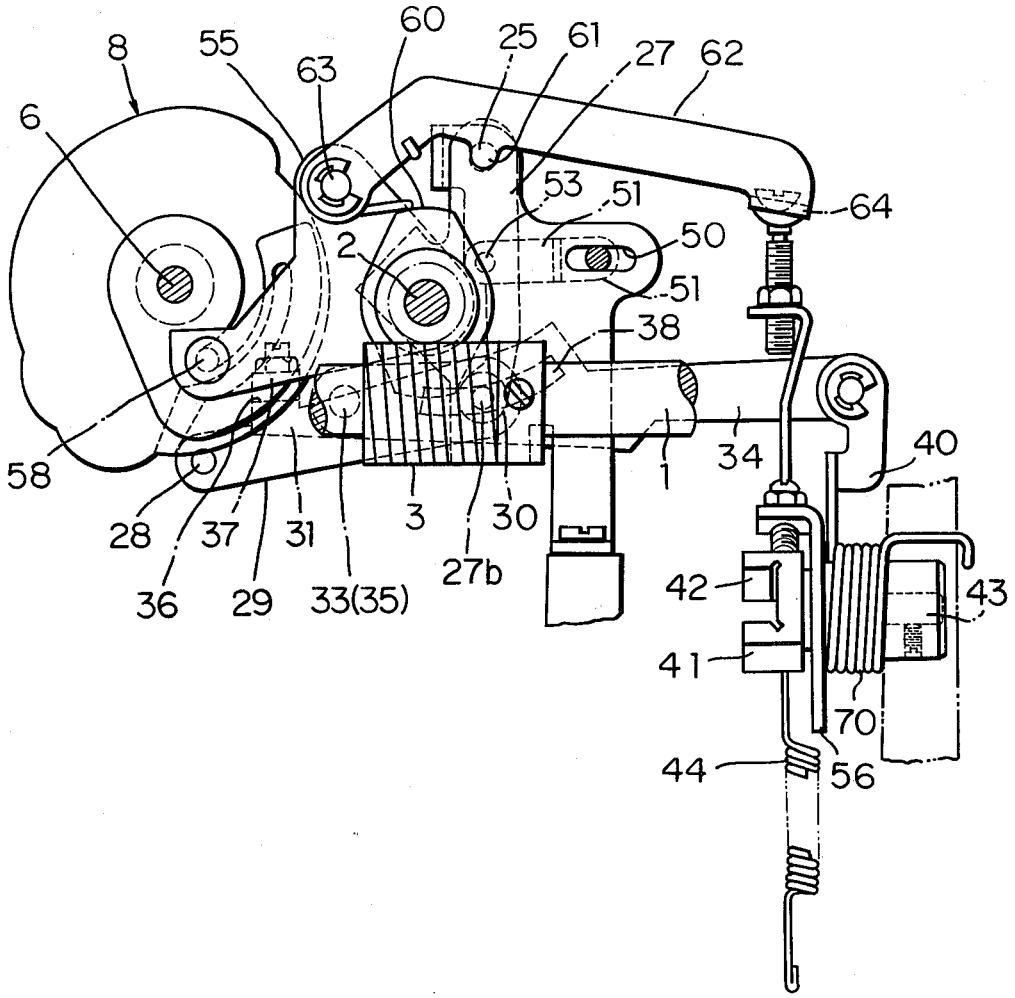
FIG. 3 is a front elevational view of the invention showing one operation thereof.
Figure 4:
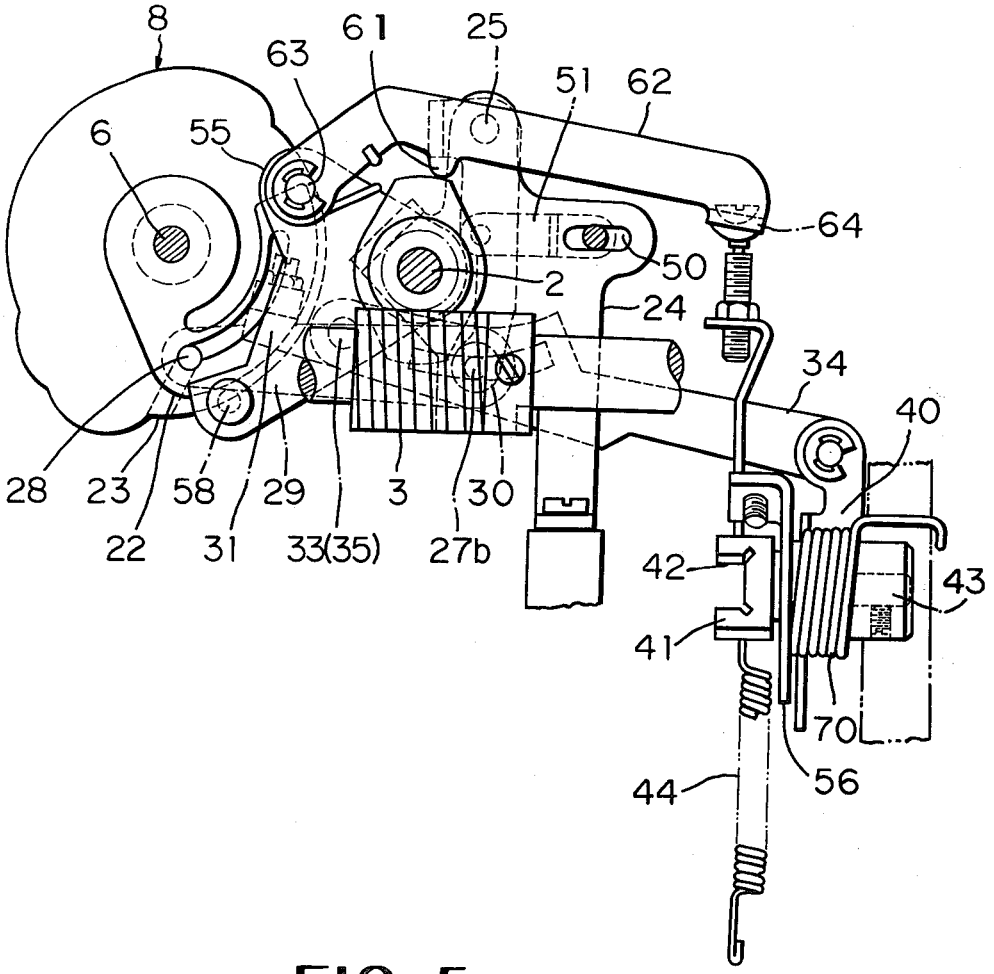
FIG. 4 is a front elevational view of the invention showing another operation thereof.
Figure 5:
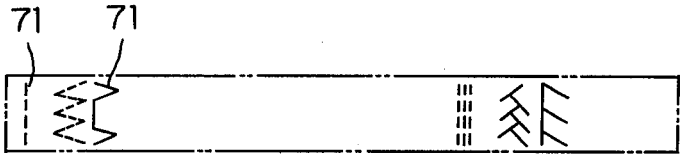
FIG. 5 is a front elevational view of the pattern indications of the invention.

A follower member 55 is at the base 57 thereof turnably mounted on the cam shaft 2, and has a follower pin 58 at one end thereof which is pressed against a cam 22 of the cam group 8A by a torsion spring 59. As shown, a follower rod 62 is at the base 63 thereof turnably mounted on the follower member 55. The follower rod 62 is formed with a follower 61 which is positioned opposite to a feed control cam 60 in the cam group 5 and is selectively brought into engagement with the feed control cam 60. The other end 64 of the follower rod 62 is directly connected to the feed adjuster 41 through a bolt 65 and other linkage as shown in FIG. 3. In FIG. 1, the reference numeral 66 is a pattern pointer which is mounted on a belt or a rope 68 and is laterally moved along the pattern indications as shown in FIG. 4 on the front panel of the sewing machine to selectively idenify the pattern indications as they are selected by rotating the operating dial 7.

The operation of the device is as follows; If the operating dial 7 is manually rotated, the control cam groups 8, 8A are rotated. Therefore, the transmission rod 16 is turned in the clockwise direction in FIG. 1 together with the needle mechanism 9 around the pivot pin 11 due to the cooperation of the follower 19 and the peripheral control cam 20 of the cam group 8. As the result, the cam follower 18 of the transmission rod 16 is disengaged from the needle control pattern cam group 5 which is to be rotated by the drive shaft 1 as generally known. As the operating dial is further rotated, the transmission rod 16 is turned around the pivot pin 17 in the horizontal plane due to the cooperation of the follower 19 and the side cam 21. As the result, the follower 18 is displaced along the pattern cams 69 of the cam group 8 and is brought into engagement with a pattern cam corresponding to the pattern indication 71 identified by the pointer 66 in FIG. 4.

In the range of rotation angle 360° of the operating dial 7, the feed selecting cam 22 is so formed and operated as to displace the follower rod 62 in a position spaced from the feed control cam 60 via the follower member 55 having the follower pin 58 which is in engagement with the feed selecting cam 22 as shown in FIG. 3. On the other hand, the feed adjusting cam 23 is so formed and operated as to displace the feed adjuster 41, via the follower arm 29, the transmission element 31 and the feed adjusting lever 34, thereby to provide most suitable feeding amounts in accordance to the selected patterns which are each indicated by the pointer 66. Further in this invention, the most suitable feeding amounts such as provided each in accordance to the selected patterns may be modified by ±50% by manually operating the feed adjusting dial 26. Namely if the feed adjusting dial 26 is manually operated, the bell-crank lever 47 is turned and laterally shifts the slide element 51 in the elongated slot 50. Therefore the swingable arm 27 is swung to displace the pin 27*b* relative to the arcuate slot 38 of the feed adjusting lever 34. As the result, the feed adjusting lever 34 is turned around the pin 35 engaging the hole 33 of the transmission element 31, thereby to adjust the feed adjuster 41. The relation of the arcuate slot 38 and the pin 27*b* is determined to set the feed adjuster 41 to modify the feeding amounts by ±50% in accordance to the selected patterns by predetermined angular rotation movements of the feed adjusting dial 26.

In this invention, if the operating dial 7 is rotated to a range beyond the range of rotation angle 360° thereof, the follower 18 of the transmission rod 16 is further operated to sequentially select the pattern cams 69 of the cam group 5. In the meantime, the feed selecting cam 22 displaces the follower pin 58 to a position remote from the control shaft 6 radially thereof. Therefore, the follower member 55 is turned in the counter-clockwise direction, and the follower 61 of the follower rod 62 is brought into engagement with the feed control cam 60 on the cam shaft 2. On the other hand, the feed adjusting cam 23 displaces the follower pin 28 to a position near the control shaft 6 radially thereof. Therefore, the follower arm 29 is turned in the clockwise direction around the pivot 57, and the end 36 of the transmission element 31 is released from the pressed engagement with the under face of the abutment 37 of the follower arm 29, since the end 36 is pressed against the abutment by the action of the tension spring 70 which directly acts the feed adjuster turning element 56. When the end 36 of the transmission element 31 is released from the pressed engagement with the abutment 37, the feed adjuster turning element 56 is made free via the feed adjusting lever 34 and the connecting link 40 and gives no influence to the feed adjuster 41.

Since the feed control am 60 is rotated together with the pattern cams 69 by the drive shaft 1, the feed control cam 60 automatically adjusts the feed adjuster 41 via the follower rod 62 per rotation of the drive shaft 1 and in synchronism with the lateral swinging movement of the needle bar due to the selected pattern cam 69. As the feed control cam 60 is so formed as to adjust the feed adjuster to feed the sewn fabric in the forward and backward direction, the stitch patterns can be obtained which are completely different from those obtained by the selective rotation of the operating dial 7 in the range of rotation angle 360°.

As is apparent from the foregoing description, the follower 18 engages all the pattern cams 69 one by one by the rotational selecting operations of the operating dial 7 in the range of rotation angle 360°. The follower 18 is returned to the initial one of the pattern cams 69 when the operating dial 7 makes one complete rotation, namely a rotation angle 360°, at which position of the operating dial 7, the feed adjuster turning element 56 is made free in the manner as mentioned, and at the same time, the follower rod 62 is brought into engagement with the feed control cam 60. Therefore, with further rotation of the operating dial 7 beyond the range of rotation angle 360°, the follower 18 is repeatedly brought into engagement with the pattern cams 69 one by one from the initial one while the feed control cam 60 is made operative.

I claim:

1. A sewing machine comprising a machine housing; a drive shaft rotatably mounted on the machine housing for vertically reciprocating a needle bar with a needle; a swingable support supporting the needle bar and swingable mounted on the machine housing; a group of cams rotated by the drive shaft at a reduced speed and including a plurality of pattern cams for controlling the lateral swinging movement of the needle bar and a single feed control cam for controlling a feed adjusting device; cam follower means operatively connected to the needle bar and operated to selectively engage the pattern cams for transmitting the movement in accordance to the pattern cams; means manually operated in a first operation range to selectively engage the cam follower means to the pattern cams and to select the feeding amounts individually in accordance to the selected pattern cams, said manually operated means being operated in a second operation range to select the single feed control cam in relation to the same pattern cams to be selected.

2. A sewing machine as defined in claim 1, wherein the manually operated means comprises an operating dial, a pattern selecting cam, first and second feed control selecting cams, and first and second cam followers each engaging the first and second feed control selecting cams respectively and operatively connected to the feed adjusting device independently, said second cam follower being operated to selectively engage the single feed control cam.

3. A sewing machine as defined in claim 2, wherein the operating dial may be operated in the first and second operation ranges to angularly displace the pattern selecting cams to repeatedly select the pattern cams; the first feed control selecting cam is operated in the first operation range of the operating dial to set the first cam follower for adjusting the feed adjusting device in accordance to the selected cams while the second feed control selecting cam is operated in the first operation range of the operating dial to displace the second cam follower to an inoperative position spaced from the single feed control cam.

4. A sewing machine as defined in claim 3, wherein the first feed control selecting cam is operated in the second operation range of the operating dial to displace the first cam follower into an inoperative position giving no influence to the feed adjusting device while the second feed control selecting cam is operated in the second operation range of the operating dial to displace the second cam follower into an operative position for engaging the single feed control cam.

5. A sewing machine as defined in claim 5, wherein the first operation range of the operating dial is substantially a rotation angle 360° of the operating dial, and the second operation range of the operating dial is substantially an additional rotation angle 360° of the operating dial.

6. A sewing machine as defined in claim 2, wherein the pattern selecting cam is so formed to repeatedly engage the cam follower to the pattern cams from the initial one thereof by manually rotating the operating dial in one direction.

* * * * *